US009566529B1

(12) United States Patent
Shindo

(10) Patent No.: US 9,566,529 B1
(45) Date of Patent: Feb. 14, 2017

(54) TOY TOP

(71) Applicant: TOMY COMPANY, LTD., Tokyo (JP)

(72) Inventor: Yukihiro Shindo, Inagi (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 15/251,013

(22) Filed: Aug. 30, 2016

(30) Foreign Application Priority Data

Feb. 9, 2016 (JP) ..... 2016-022318

(51) Int. Cl.
*A63H 1/00* (2006.01)
*A63H 1/06* (2006.01)

(52) U.S. Cl.
CPC ..... *A63H 1/06* (2013.01)

(58) Field of Classification Search
USPC ..... 446/256, 257, 259, 263, 264; D21/460, D21/461, 463
See application file for complete search history.

(56) References Cited

U.S. PATENT DOCUMENTS 6,626,729 B2 * 9/2003 Osawa ..... A63H 1/00 446/250
6,746,300 B1 * 6/2004 Matsukawa ..... A63H 1/06 446/256
6,769,953 B1 * 8/2004 Sutton ..... A63H 1/02 446/256
7,427,225 B2 * 9/2008 Matsukawa ..... A63H 1/04 446/256
8,066,543 B2 * 11/2011 Kitamura ..... A63F 9/16 273/110
D660,918 S * 5/2012 Ujita ..... D21/460
8,210,895 B2 * 7/2012 Bertrand ..... A63F 9/16 446/259
D665,858 S * 8/2012 Horikoshi ..... D21/460
8,986,066 B2 * 3/2015 Ferreyra ..... A63H 1/02 446/259
9,101,845 B2 * 8/2015 Cai ..... A63H 1/18
(Continued)

FOREIGN PATENT DOCUMENTS

JP 9-38337 2/1997
JP 3109118 3/2005
JP 5973631 8/2015

OTHER PUBLICATIONS

Japan Platform for Patent Information, English Abstract for JP 09-038337.

(Continued)

*Primary Examiner* — Kurt Fernstrom
(74) *Attorney, Agent, or Firm* — Staas & Halsey LLP

(57) ABSTRACT

A toy top includes: a body and a shaft part respectively having first and second portions facing each other in an up-down direction in a combined state; and a sliding contact surface which is on the first portion and abuts a projection on the second portion by biasing force of a biasing member. The projection continuously slides from a first position corresponding to a most deeply combined state to a second position corresponding to an uncombined state. The sliding contact surface is an inclined plane which, in the combined state: as a whole, inclines with respect to a plane at right angles to a shaft line of the shaft part; has a level in the up-down direction being continuously lower from the first position toward the second position; and can keep abutting the projection at an arbitrary point.

8 Claims, 7 Drawing Sheets

(56) References Cited

U.S. PATENT DOCUMENTS

| | | | | |
|---|---|---|---|---|
| 2002/0102907 | A1 | 8/2002 | Osawa | |
| 2005/0142983 | A1 | 6/2005 | Matsukawa et al. | |
| 2011/0177750 | A1* | 7/2011 | Ujita | A63H 1/04 446/263 |
| 2011/0306269 | A1* | 12/2011 | Horikoshi | A63H 1/12 446/261 |

OTHER PUBLICATIONS

Notice of Allowance for Japanese Patent Application No. 2016-022318, issued Jun. 21, 2016.

* cited by examiner

TOY TOP

CROSS-REFERENCE TO RELATED APPLICATIONS

This application is based upon and claims the benefit of priority under 35 USC 119 of Japanese Patent Application No. 2016-022318 filed on Feb. 9, 2016, the entire disclosure of which, including the specification, claims, drawings and abstract, is incorporated herein by reference in its entirety.

BACKGROUND OF THE INVENTION

1. Field of the Invention

The present invention relates to a toy top.

2. Description of the Related Art

As a battle game using toy tops, there is an enjoyable game, for example, in which a rotating (i.e., spinning) toy top collides with an opponent's rotating toy top in a dedicated field, and, by the impact force, hits the opponent's toy top out of the field or disassembles the opponent's toy top into a body and a shaft part.

An example of the toy top (s) used in the above battle game is described in Japanese Patent No. 5,793,631.

This toy top is configured such that, by biasing force of a spring, the upper surfaces of pawls of a body positioned on the upper side abut the lower surfaces of pawls of a shaft part positioned on the lower side in the up-down direction and also gears of the body mesh with projections of the shaft part in the up-down direction.

When this toy top collides with another, the body of the toy top is prevented from rotating by the impact force generated by the collision, but the shaft part thereof tries to keep rotating, whereby the body and the shaft part rotate in directions opposite each other. Consequently, the abutting of the upper surfaces of the pawls of the body and the lower surfaces of the pawls of the shaft part is released, and the toy top disassembles into the body and the shaft part.

By the way, in the toy top described in Japanese Patent No. 5,793,631, the meshing of the gears of the body with the projections of the shaft part acts as rotational resistance when the body and the shaft part rotate in the directions opposite each other. This rotational resistance makes a relative rotation amount of the body and the shaft part of the time the toy top collides with another small. Hence, the toy top disassembles into the body and the shaft part when receives the impact force not just one time but multiple times.

In the case of the toy top described in Japanese Patent No. 5,793,631, however, the gears of the body and the projections of the shaft part are small, and hence when the body and the shaft part rotate relative to each other, and thereby the gears and the projections rub against each other, the gears and the projections may be worn away and torsional resistance (i.e., rotational resistance) may decrease. If the gears and the projections are worn away or cracked as described above, characteristics of the toy top deteriorate. Therefore, for the toy top, resin material having excellent abrasion resistance needs to be used, which increases costs.

SUMMARY OF THE INVENTION

The present invention has been conceived in view of the above problems, and objects of the present invention include providing, without increase in costs, a toy top for a battle (s) with little deterioration of characteristics.

In order to achieve the above and/or other objects, according to an aspect of the present invention, there is provided a toy top for a battle, including: a body disposed on an upper side and having a first pawl; and a shaft part disposed on a lower side and having a second pawl, wherein the body and the shaft part take (i) a combined state in which the first pawl and the second pawl are superposed in an up-down direction such that an upper surface of the first pawl faces a lower surface of the second pawl and (ii) an uncombined state in which the first pawl and the second pawl are not superposed in the up-down direction, according to a relative position of the shaft part to the body reached by a relative rotation of the shaft part to the body on a shaft line of the shaft part, the body and the shaft part go into the combined state from the uncombined state by the shaft part being rotated relative to the body in a predetermined direction, when the body and the shaft part reach the uncombined state by the shaft part being rotated relative to the body in a direction opposite to the predetermined direction by impact received during rotation of the toy top, the body and the shaft part become uncombined, whereby the toy top disassembles into the body and the shaft part, the body and the shaft part respectively have a first portion and a second portion formed to face each other in the up-down direction in the combined state, the toy top further includes: a biasing member; a projection; and a sliding contact surface which abuts the projection by biasing force of the biasing member and on which the projection continuously slides from a position corresponding to a most deeply combined state in the combined state to a position corresponding to the uncombined state, the sliding contact surface is formed on the first portion of the body, and the projection is formed on the second portion of the shaft part, and the sliding contact surface is an inclined plane which, in the combined state, (i) as a whole, inclines with respect to a plane being at right angles to the shaft line, (ii) has a level in the up-down direction being continuously lower from the position corresponding to the most deeply combined state toward the position corresponding to the uncombined state and (iii) can keep abutting the projection at an arbitrary point.

According to another aspect of the present invention, there is provided a toy top for a battle, including: a body disposed on an upper side and having a first pawl; and a shaft part disposed on a lower side and having a second pawl, wherein the body and the shaft part take (i) a combined state in which the first pawl and the second pawl are superposed in an up-down direction such that an upper surface of the first pawl faces a lower surface of the second pawl and (ii) an uncombined state in which the first pawl and the second pawl are not superposed in the up-down direction, according to a relative position of the shaft part to the body reached by a relative rotation of the shaft part to the body on a shaft line of the shaft part, the body and the shaft part go into the combined state from the uncombined state by the shaft part being rotated relative to the body in a predetermined direction, when the body and the shaft part reach the uncombined state by the shaft part being rotated relative to the body in a direction opposite to the predetermined direction by impact received during rotation of the toy top, the body and the shaft part become uncombined, whereby the toy top disassembles into the body and the shaft part, the body and the shaft part respectively have a first portion and a second portion formed to face each other in the up-down direction in the combined state, the toy top further includes: a biasing member; a projection; and a sliding contact surface which abuts the projection by biasing force of the biasing member and on which the projection continuously slides from a position corresponding to a most deeply combined state in the combined state to a position corresponding to the uncombined state, the projection is formed on the first portion of the body, and the sliding contact surface is formed on the second portion of the shaft part, and the sliding contact surface is an inclined plane which, in the combined state, (i) as a whole, inclines with respect to a plane being at right angles to the shaft line, (ii) has a level in the up-down direction being continuously higher from the position corresponding to the most deeply combined state toward the position corresponding to the uncombined state and (iii) can keep abutting the projection at an arbitrary point.

BRIEF DESCRIPTION OF THE DRAWINGS

The present invention is fully understood from the detailed description given hereinafter and the accompanying drawings, which are given by way of illustration only, and thus are not intended to limit the present invention, wherein.

DETAILED DESCRIPTION

Hereinafter, a toy top according to embodiments of the present invention is described with reference to the drawings.

Overall Configuration

Figure 1:
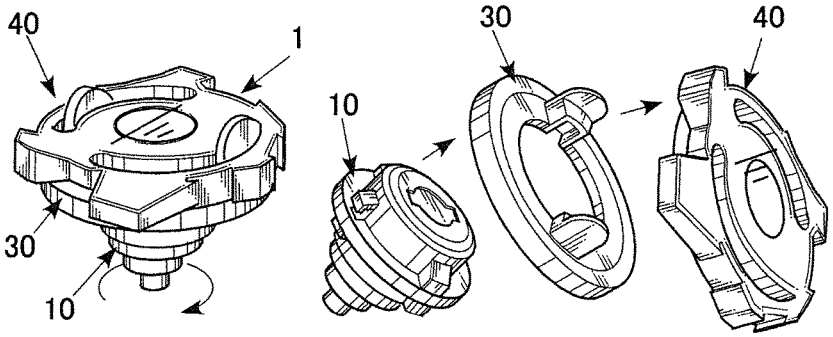
FIG. 1 is a drawing to explain how to play with a toy top (s) according to an embodiment of the present invention.
Figure 2:
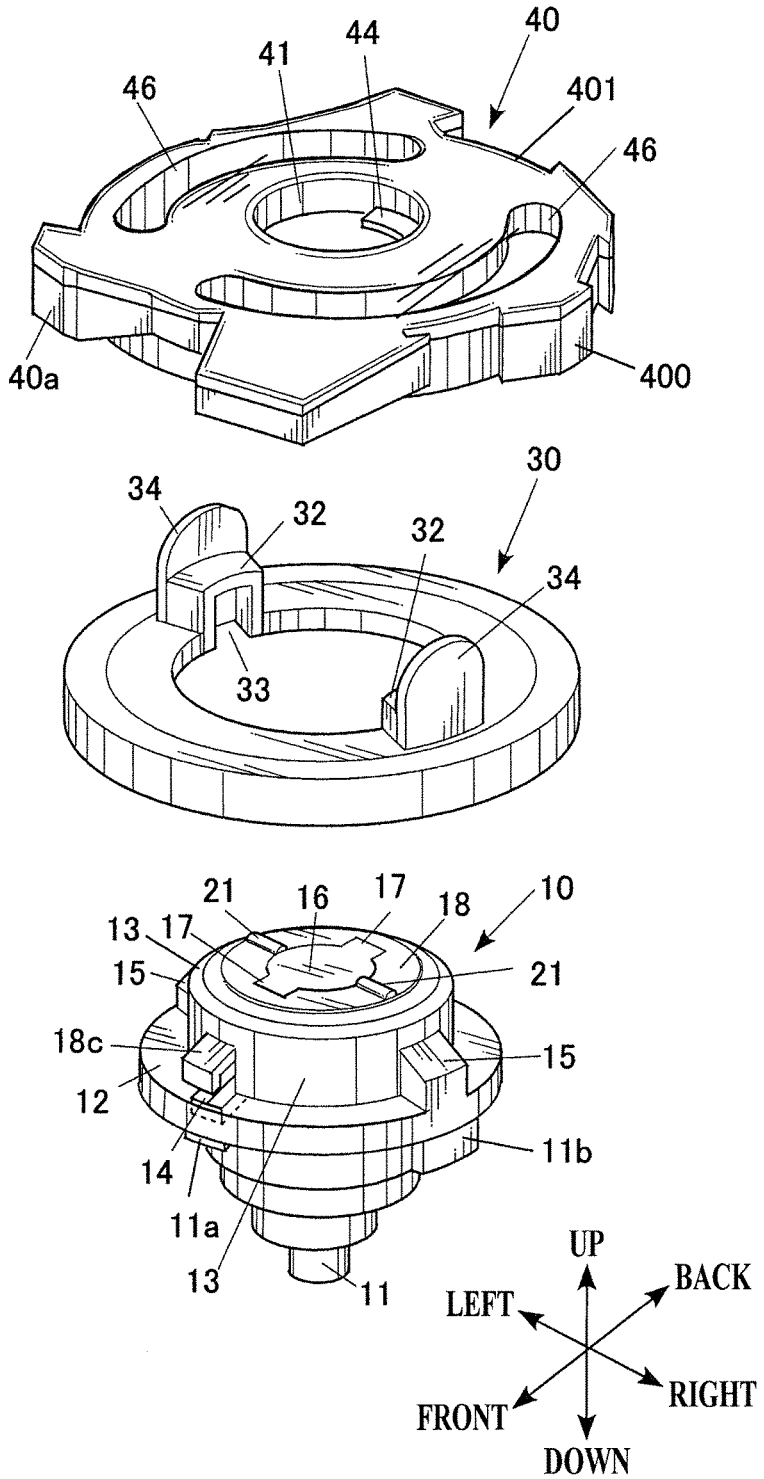
FIG. 2 is an exploded perspective view of the toy top according to the embodiment.
Figure 3:
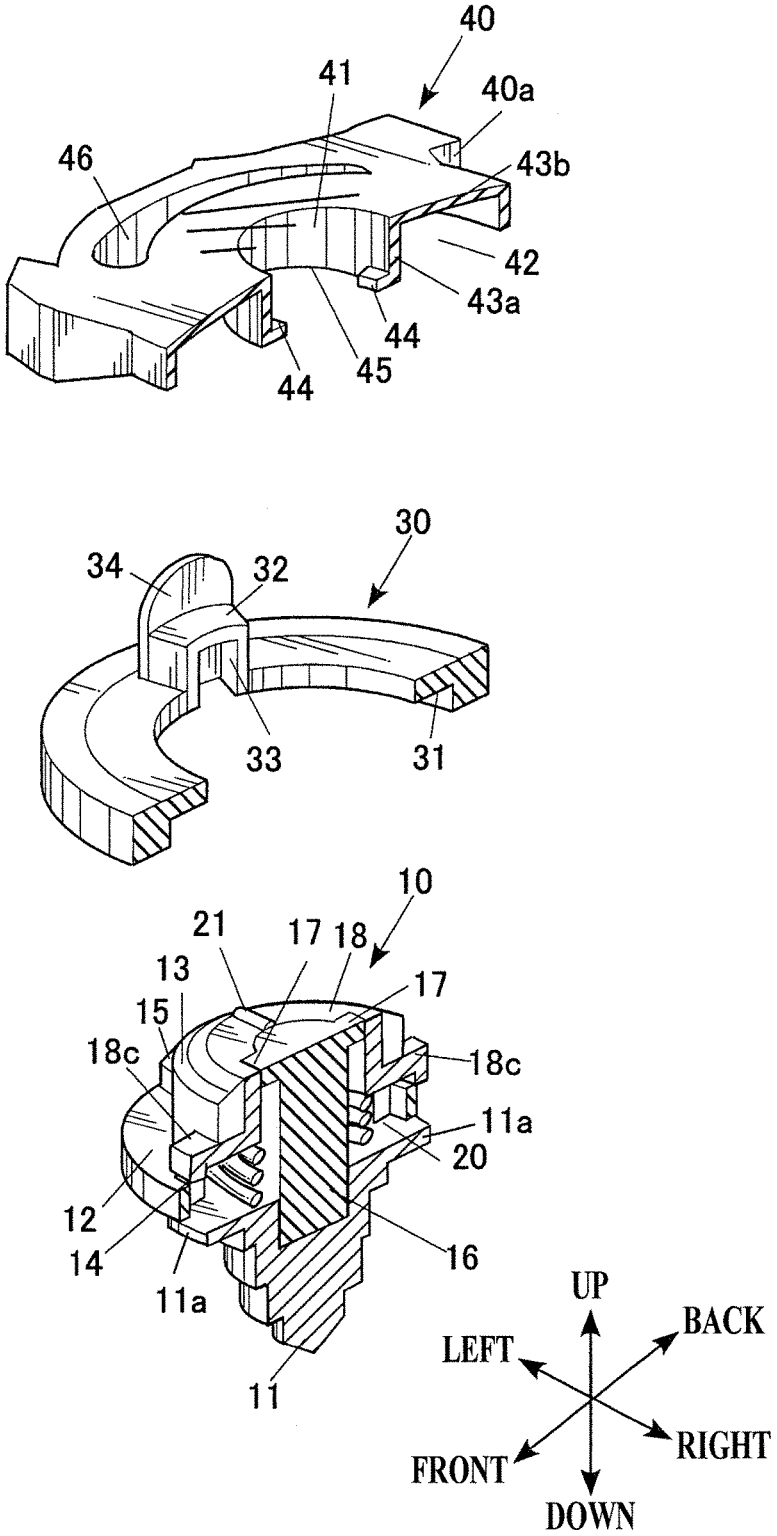
FIG. 3 is an exploded cross-sectional perspective view of the toy top according to the embodiment.

FIG. 1 is a drawing to explain how to play with a toy top (s) according to an embodiment of the present invention, FIG. 2 is an exploded perspective view of the toy top, and FIG. 3 is an exploded cross-sectional perspective view of the toy top. In this application, up and down, right and left, and front and back are directions shown in FIGS. 2 and 3.

A toy top 1 of the embodiment is a toy top which can be used in a top battle game. More specifically, this toy top 1 can be used in a top battle game in which the toy top 1 wins when, as shown at the right side of FIG. 1, disassembles an opponent's toy top 1 by impact force generated by collision with each other.

As shown in FIGS. 2 and 3, the toy top 1 includes: a shaft part 10 which constitutes the lower structure and functions as a driver; and a performance changing ring 30 and a body 40 which constitute the upper structure.

<<Detailed Configuration>>

1. Shaft Part 10

As shown in FIG. 2, the shaft part 10 includes: a rotating shaft 11 at the lower part, a flange 12 at the middle part in the up-down direction; and a hollow cylindrical part 13 at the upper part. These rotating shaft 11, flange 12 and cylindrical part 13 are formed of synthetic resin. The material is not limited to synthetic resin, and hence the rotating shaft 11, the flange 12 and the cylindrical part 13 may be partly or entirely formed of metal.

Of these, the flange 12 and the cylindrical part 13 are formed as a single unit and fixed to the rotating shaft 11 with screws 11*c*. (Refer to a bottom view shown in FIG. 4.)

The rotating shaft 11 tapers stepwise from the flange 12 side to the tip side of the rotating shaft 11 and, as a whole, is approximately in the shape of an inverted cone.

Figure 4:
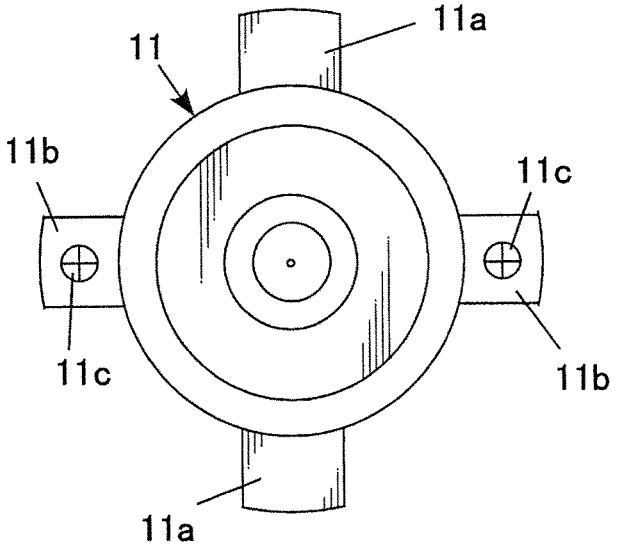
FIG. 4 is a bottom view of a rotating shaft according to the embodiment.

In the flange 12 and the cylindrical part 13, holes 14 are formed at two points opposite each other in the front-back direction with a shaft line of the rotating shaft 11 in between. On the upper part of the rotating shaft 11, as shown in FIGS. 2 and 4, projecting pieces 11*a* projecting outward in the radius direction are formed at points corresponding to the respective holes 14 of the flange 12. The holes 14 of the flange 12 are covered with the projecting pieces 11*a* from below. The upper surfaces of the projecting pieces 11*a* constitute the below-described seat parts.

On the cylindrical part 13, projecting parts 15 are formed at two points opposite each other in the right-left direction with the shaft line of the rotating shaft 11 in between. The outer surfaces of the projecting parts 15 are integrated with the outer circumferential surface of the flange 12. On the upper part of the rotating shaft 11, as shown in FIGS. 2 and 4, projecting parts 11*b* projecting outward in the radius direction are formed at points corresponding to the respective projecting parts 15. At the positions of the projecting parts 15 and 11*b*, the flange 12 and the cylindrical part 13 are fixed to the rotating shaft 11 with the screws 11*c*.

Further, as shown in FIG. 13, in the cylindrical part 13, a solid cylinder 16 stands. The base end of the solid cylinder 16 is connected to the rotating shaft 11. The upper end of the solid cylinder 16 is not particularly limited, but set at a higher position than the upper end of the cylindrical part 13. On the upper end part of the solid cylinder 16, pawls (i.e., second pawls) 17 projecting outward in the radius direction are formed at two points opposite each other in the front-back direction with the shaft line of the rotating shaft 11 in between.

The shaft part 10 includes a movable hollow cylindrical pressing member (i.e., a biasing member) 18. The pressing member 18 is formed of synthetic resin, but may be formed of metal. The pressing member 18 is placed in the cylindrical part 13 in such a way as to surround the outer circumference of the solid cylinder 16.

Figure 5:
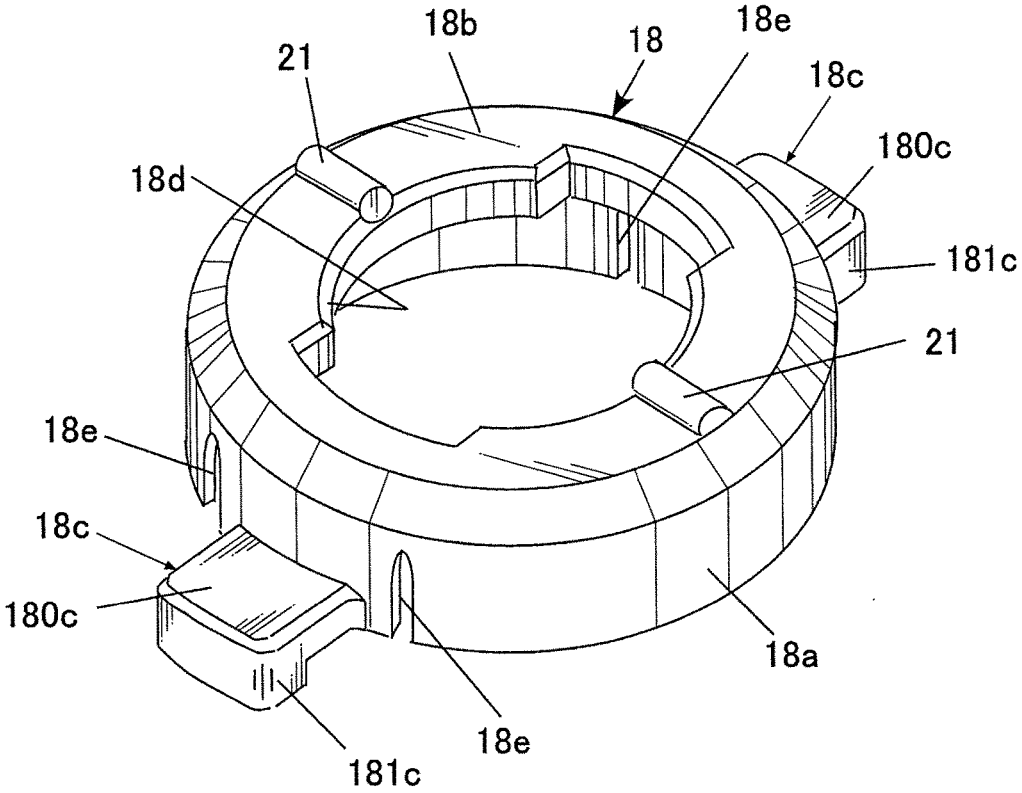
FIG. 5 is a perspective view of a pressing member according to the embodiment.

As shown in FIG. 5, the pressing member 18 includes a hollow cylindrical part (i.e., a hollow cylinder/prism) 18*a*, a ceiling part 18*b* and leg parts 18*c*.

The ceiling part 18*b* is disposed on the upper end of the cylindrical part 18*a*. In the ceiling part 18*b*, a hole 18*d* having a shape which fits the upper end part of the solid cylinder 16 is formed.

The leg parts 18*c* are disposed on the lower end part of the outer circumference (i.e., an outer circumferential wall) of the cylindrical part 18*a*. The leg parts 18*c* are formed at two points opposite each other in the front-back direction with the shaft line of the rotating shaft 11 in between. Each leg part 18*c* includes: a horizontal part 180*c* which horizontally projects from the cylindrical part 18*a*; and a vertical part 181*c* which vertically extends downward from the tip of the horizontal part 180*c*.

In the cylindrical part 18*a*, slits 18*e* are formed. The slits 18*e* are made in the lower end of the cylindrical part 18*a* at both sides of each leg part 18*c*. The part defined by the slits 18*e* made at the both sides of each leg part 18*c* constitutes a support part for the leg part 18*c*. Presence of these slits 18*e* at the both sides of the respective leg parts 18*c* makes it easy for the leg parts 18*c* and the support parts to elastically deform when force acts on (i.e., is applied to) the pressing member 18 from above in a state in which the leg parts 18*c* sit on the upper surfaces of the projecting pieces 11*a*.

Thus-configured pressing member 18 is placed such that the leg parts 18*c* are inserted into the holes 14. The holes 14 are set to be larger than the leg parts 18*c* in the up-down direction, so that the pressing member 18 is movable in the up-down direction. Upward movement of the pressing member 18 is restricted by the leg parts 18*c* contacting the upper edges of the holes 14, whereas downward movement of the pressing member 18 is restricted by the leg parts 18*c* sitting on the seat parts constituted of the upper surfaces of the projecting pieces 11*a*.

The pressing member 18 is biased upward by biasing force of a coil spring 20 wounded around the solid cylinder 16. In a state in which the shaft part 10 and the body 40 are not combined, the leg parts 18*c* of the pressing member 18 abut the upper edges of the holes 14 by the biasing force of the coil spring 20, and the upper end of the pressing member 18 and the upper end of the cylindrical part 13 are at the same height position (i.e., at the same level).

On the upper surface of the ceiling part 18*b* of the pressing member 18, ridges (i.e., projections) 21 extending in the radius direction are formed at two points opposite each other in the right-left direction with the shaft line of the rotating shaft 11 in between.

2. Performance Changing Ring 30

In this embodiment, as the performance changing ring 30, a flywheel is used. This performance changing ring 30 is in the shape of a plate. On the bottom of the performance changing ring 30, a ring-shaped step part 31 where the flange 12 of the shaft part 10 can be housed from below is formed. Further, on the upper surface of the performance changing ring 30, projecting parts 32 projecting upward are formed at two points opposite each other in the right-left direction with the shaft line of the rotating shaft 11 in between. On the lower side parts of the projecting parts 32, recessed parts 33 where the projecting parts 15 of the shaft part 10 can be housed from below are formed. Further, on the upper surface of the performance changing ring 30, tongue pieces 34 extending upward are formed at the immediate outer side of the projecting parts 32. The tongue pieces 34 project higher than the projecting parts 32. As the performance changing ring 30, instead of or integrated with the flywheel, one having projecting parts on the outer circumferential surface to make it easy to attack an opponent's toy top 1 or one having recessed parts on the outer circumferential surface to make it hard to be attacked by an opponent's toy top 1 may be used.

3. Body 40

The body 40 is in the shape of a disk. As shown in FIG. 2, the body 40 includes: a base 400; and a transparent cover 401 having approximately the same shape as the base 400 in the top view and put on the base 400.

On the outer circumference of the body 40, odd-shaped parts 40*a* are formed. In the center of the base 400, a round hole 41 is formed. The upper end of the opening, namely, the round hole 41, is covered with the transparent cover 401. On the lower surface of the body 40, a ring-shaped recessed part 42 where the projecting parts 32 of the performance changing ring 30 can be housed from below is formed. On the lower end of the inner circumferential surface of an inner circumferential wall 43*a* which defines the ring-shaped recessed part 42, pawls (i.e., first pawls) 44 projecting inward in the radius direction are formed at two points opposite each other in the front-back direction with the shaft line of the rotating shaft 11 in between.

On the lower end surface of the inner circumferential wall 43*a*, sliding contact surfaces 45 on which the ridges 21 slide are formed at two points opposite each other in the right-left direction with the shaft line of the rotating shaft 11 in between. The sliding contact surfaces 45 each incline, in a predetermined direction, with respect to a plane which is at right angles to the shaft line of the rotating shaft 11 (i.e., a horizontal plane). That is, the sliding contact surfaces 45 each incline in such a direction that bitterness (resistance) increases as the body 40 combined with the shaft part 10 rotates in a direction to separate from the shaft part 10. More specifically, each sliding contact surface 45 is an inclined plane which has a height position (i.e., a level) in the up-down direction being continuously lower from the most deeply combined state toward the uncombined state, and can keep abutting the ridge 21 (i.e., can hold the abutted ridge 21 not to move either forward or backward) at an arbitrary point thereon. This is the difference from a simple projection having an inclined plane (s).

In a ceiling wall 43*b* which defines the ring-shaped recessed part 42 of the body 40, arc slits 46 into which the tongue pieces 34 of the performance changing ring 30 can be inserted from below are formed. The arc slits 46 each have a length for the respective tongue pieces 34 to move sufficiently.

<<Assembling Method>>

Next, an example of an assembling method of the toy top 1 is described.

Figure 6A:
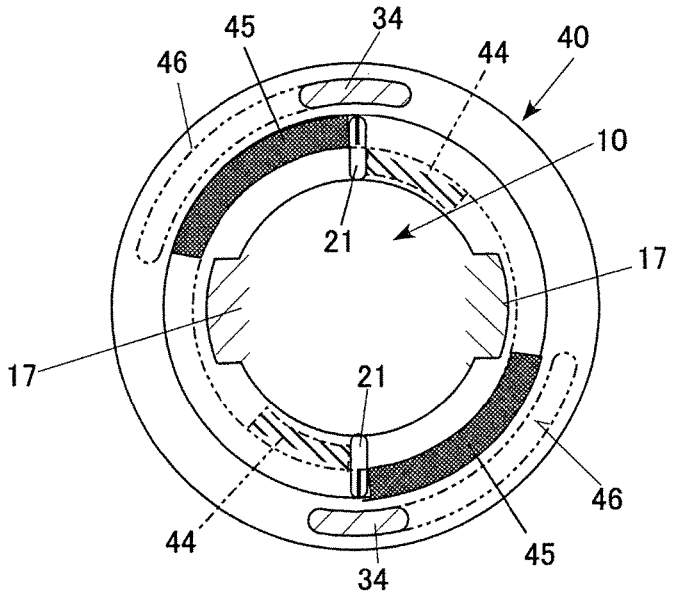
FIGS. 6A and 6B respectively show an uncombined state and a combined state of a main part (i.e., a shaft part), a body and a flywheel of the toy top according to the embodiment.
Figure 6B:
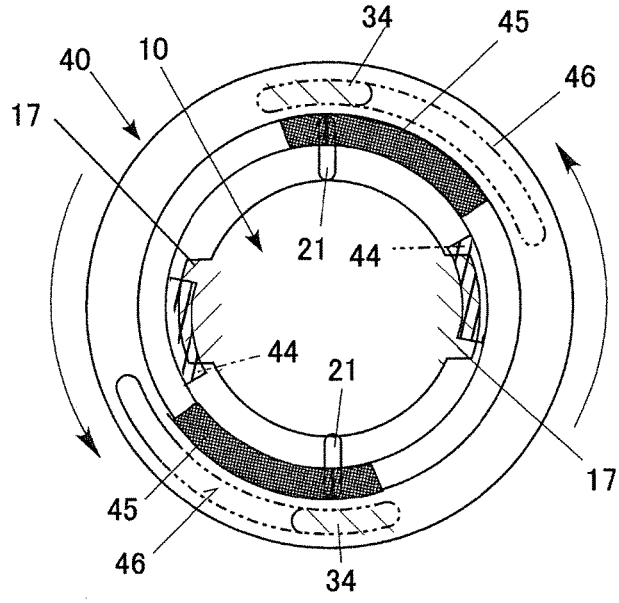

First, the projecting parts 15 of the shaft part 10 are fitted into the recessed parts 33 of the performance changing ring 30 from below, whereby the shaft part 10 and the performance changing ring 30 are united, namely, go into a fitted state. Next, this assembly is brought closer to the body 40 from below. At the time, the tongue pieces 34 of the performance changing ring 30 of the assembly are fitted at predetermined ends of the arc slits 46 of the body 40 (shown in FIG. 6A). This state is a state in which the pawls 17 of the shaft part 10 and the pawls 44 of the body 40 are not superposed in the up-down direction. This state is called the uncombined state. Then, the shaft part 10 of the assembly is pressed to the body 40. At the time, first, the performance changing ring 30 is pressed to the lower surface of the body 40. When the shaft part 10 of the assembly is further pressed to the body 40, the leg parts 18*c* of the shaft part 10 are pressed downward by the lower surface of the performance changing ring 30 against the biasing force of the coil spring 20, whereby the leg parts 18*c* sit on the seat parts constituted of the upper surfaces of the projecting pieces 11*a*. When the shaft part 10 of the assembly is further pressed to the body 40, the leg parts 18*c* and the support parts of the pressing member 18 elastically deform, and the coil spring 20 is further compressed, whereby the pawls 17 of the shaft part 10 are pushed up higher than the pawls 44 of the body 40. Then, the shaft part 10 united with the performance changing ring 30 is rotated relative to the body 40 (in a direction indicated by arrows in FIG. 6B) until the tongue pieces 34 reach the opposite ends of the arc slits 46 to the predetermined ends thereof (shown in FIG. 6B). This rotation is rotation of the shaft part 10 and the performance changing ring 30 relative to the body 40. FIG. 6B shows a state in which the body 40 has been rotated relative to the shaft part 10 and the performance changing ring 30. In this state, the pawls 17 of the shaft part 10 and the pawls 44 of the body 40 are superposed in the up-down direction. When a user lets go of the shaft part 10, the lower surfaces of the pawls 17 of the shaft part 10 abut the upper surfaces of the pawls 44 of the body 40 by elastic force (i.e., biasing force) of the leg parts 18*c* and the support parts of the pressing member 18 and the biasing force of the coil spring 20. In this state, in which the lower surfaces of the pawls 17 of the shaft part 10 abut the upper surfaces of the pawls 44 of the body 40, (i) the elastic force of the leg parts 18*c* and the support parts of the pressing member 18 have just been released, or (ii) the elastic force of the leg parts 18*c* and the support parts of the pressing member 18 is released, the leg parts 18*c* float up from the projecting pieces 11*a*, and the projections 21 abut the sliding contact surfaces 45 by the biasing force of the coil spring 20 only.

The state in which the lower surfaces of the pawls 17 of the shaft part 10 abut the upper surfaces of the pawls 44 of the body 40 is called the combined state.

Thus, the shaft part 10, the performance changing ring 30 and the body 40 are combined, whereby the toy top 1 is assembled.

[How to Play]

Next, an example of how to play with the toy top 1 is described.

In this example, the toy top 1 is rotated to battle with an opponent's toy top 1.

Figure 8:
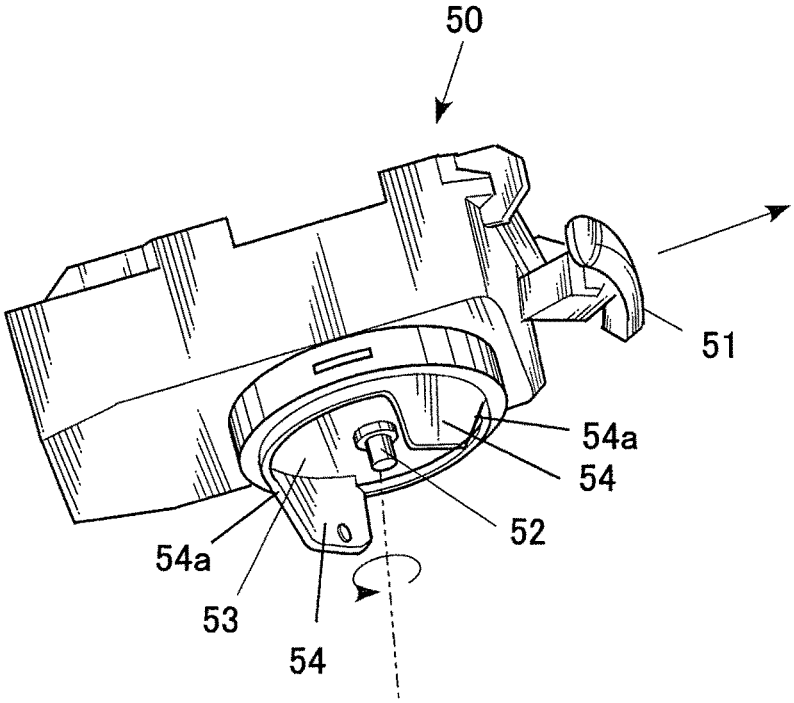
FIG. 8 is a perspective view showing an example of a launcher which rotationally drives the toy top according to the embodiment.

Turning force of the toy top 1 is provided, for example, by a launcher 50 shown in FIG. 8. This launcher 50 includes a not-shown circular plate therein, and the circular plate is biased in a certain rotational direction by a not-shown flat spiral spring. When a not-shown string wounded around the circular plate is pulled with a handle 51, the circular plate rotates and thereby a top holder 53 rotates. This rotation of the top holder 53 is transmitted to the toy top 1 by forks 54 which project downward from the top holder 53, thereby rotating the toy top 1. The forks 54 are inserted into the arc slits 46 of the body 40. When the handle 51 of the launcher 50 is pulled to the end, the circular plate and, by extension, the top holder 53, stop rotating, whereas the toy top 1 still rotates with inertial force. Thereby, the toy top 1 separates from the top holder 53, following inclined planes 54*a* of the forks 54. In FIG. 8, the reference number "52" represents a rod which can come out from and go into the top holder 53. When the toy top 1 is mounted on the top holder 53, the rod 52 is pressed by the upper surface of the toy top 1, whereby the rod 52 goes into the top holder 53. This rod 52 is used, for example, to detect attachment/detachment of the toy top 1 to/from the launcher 50.

Thus-launched toy top 1 rotates in a predetermined field, and when the toy top 1 collides with another, by the impact force, the friction and so forth generated by the collision, force in a direction opposite to the rotating direction in which the shaft part 10 and the performance changing ring 30 (i.e., the toy top 1) are rotating acts on the body 40, whereby the body 40 rotates in the direction opposite to the rotating direction of the shaft part 10 and the performance changing ring 30.

Figure 7:
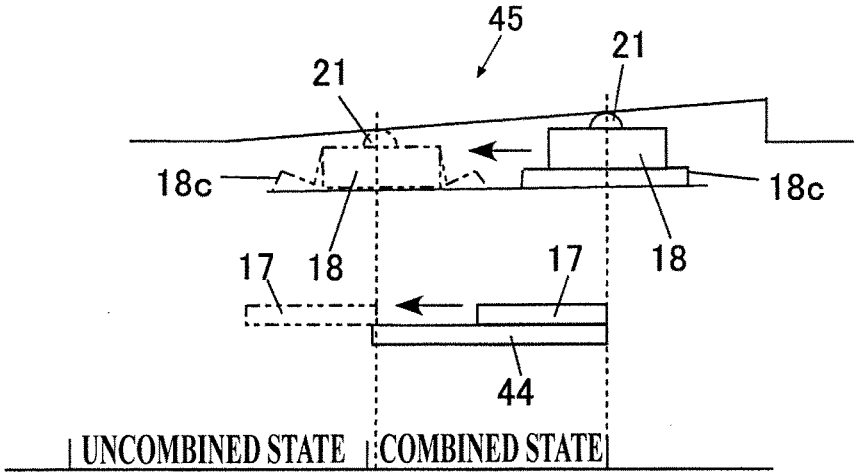
FIG. 7 shows a positional relationship of a sliding contact surface, a projection, the pressing member and pawls according to the embodiment.

Then, the ridges 21 slide on the sliding contact surfaces 45 of the body 40. At the time, the elastic force of the leg parts 18*c* and the support parts of the pressing member 18 and the biasing force of the coil spring 20 act on the ridges 21. Therefore, when the impact force generated by the collision is lost, the ridges 21 are positioned there. When the ridges 21 each reach the position corresponding to the uncombined state from the position indicated by a sold line (s) via the position indicated by a two-dot chain line (s) shown in FIG. 7, the pawls 44 of the body 40 separate from the pawls 17 of the shaft part 10. Thus, the body 40 separates from the shaft part 10 by the biasing force of the coil spring 20. Then, the toy top 1 is disassembled as shown at the right side of FIG. 1.

Modifications

In the above, an embodiment of the present invention is described. Needless to say, however, the present invention is not limited to the embodiment and can be appropriately and variously modified without departing from the spirit of the present invention.

Figure 9A:
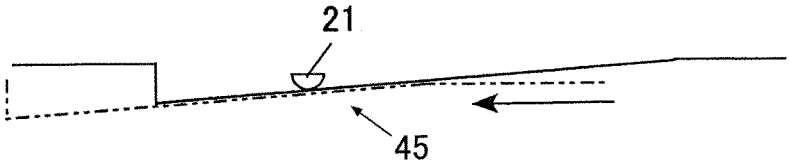
FIGS. 9A and 9B show a positional relationship of the sliding contact surface, the projection, the pressing member and the pawls according to a modification of the present invention.
Figure 9B:
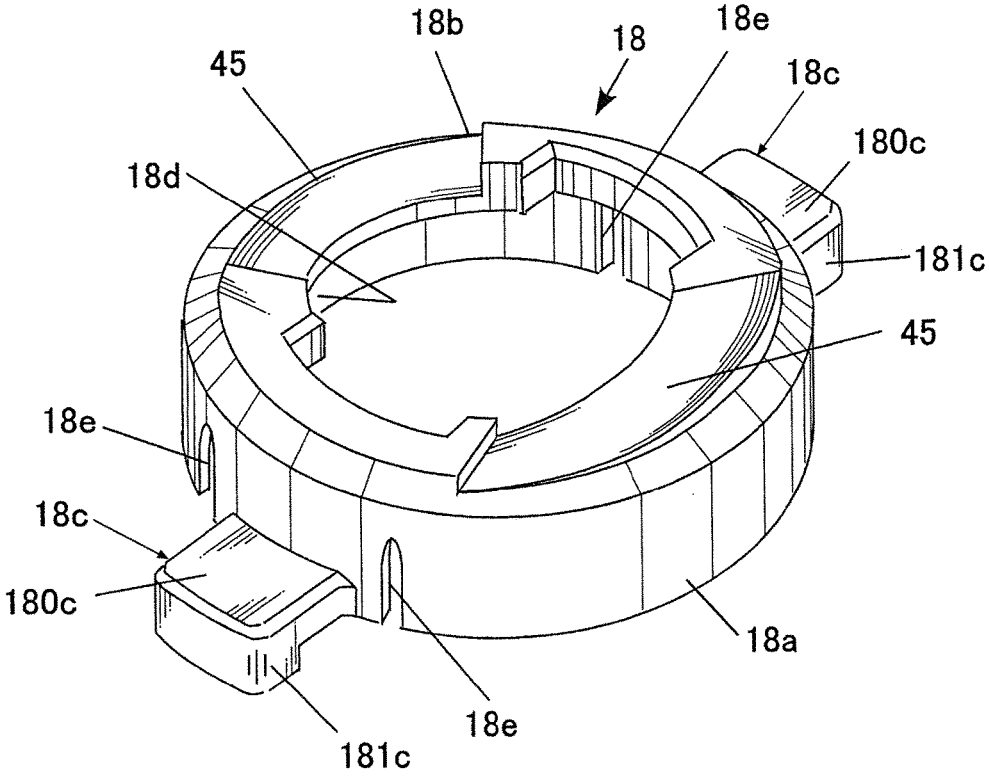

For example, in the above embodiment, the ridges 21 are formed on the pressing member 18 of the shaft part 10, and the sliding contact surfaces 45 are formed on the body 40. To the contrary, as shown in FIGS. 9A and 9B, the sliding contact surfaces 45 may be formed on the pressing member 18 of the shaft part 10, and the ridges 21 may be formed on the body 40.

Further, in the above embodiment, the coil spring 20 is provided. This coil spring 20 is to make the body 40 spring out of the shaft part 10 in the uncombined state. However, when the body 40 and the shaft part 10 are in the uncombined state, the body 40 and the shaft part 10 detach from each other by the rotation of the toy top 1. Therefore, the coil spring 20 is inessential.

Further, in the above embodiment, inclination of each sliding contact surface 45 from the most deeply combined state to the uncombined state is uniform. However, the inclination may be large at first (i.e., the most deeply combined state) and small at the end (i.e., the uncombined state), or vice versa. Further, a flat part(s) may be formed midway, at first and/or at the end. In short, what is necessary for the sliding contact surfaces 45 is to be able to keep abutting the ridges 21 at arbitrary points.

Further, in the above embodiment, the toy top 1 which rotates clockwise in the top view is described. It is a matter of course, however, that the present invention is also applicable to a toy top 1 which rotates counterclockwise in the top view. The toy top 1 which rotates counterclockwise in the top view (i.e., the toy top 1 assembled by rotating the body 40 counterclockwise in the top view relative to the shaft part 10 and the performance changing ring 30) can be easily realized by changing the body 40 only, using the same shaft part 10 and the same performance changing ring 30 as the above.

Further, in the above embodiment, a case where toy tops 1, 1 each of which rotates clockwise in the top view battle with each other is described. However, it is also possible that toy tops 1, 1 each of which rotates counterclockwise in the top view battle with each other.

It is also possible that a toy top 1 which rotates clockwise in the top view and a toy top 1 which rotates counterclockwise in the top view battle with each other. In this case, when the toy tops 1, 1 collide with and rub against each other, the body 40 of each toy top 1 rotates relative to the shaft part 10 thereof from the uncombined state to the combined state; in other words, the body 40 rotates in a direction in which the body 40 is tightly screwed on the shaft part 10. Therefore, in this case, it is difficult for a toy top 1 to disassemble an opponent's toy top 1 by colliding with and rubbing against the opponent's toy top 1, but a battle, for example, in which a toy top 1 wins by hitting an opponent's toy top 1 out of a predetermined field can be enjoyed.

It is a matter of course that three toy tops 1, 1, 1 or more can fight a battle.

According to an aspect of the present invention, there is provided a toy top for a battle, including: a body disposed on an upper side and having a first pawl; and a shaft part disposed on a lower side and having a second pawl, wherein the body and the shaft part take (i) a combined state in which the first pawl and the second pawl are superposed in an up-down direction such that an upper surface of the first pawl faces a lower surface of the second pawl and (ii) an uncombined state in which the first pawl and the second pawl are not superposed in the up-down direction, according to a relative position of the shaft part to the body reached by a relative rotation of the shaft part to the body on a shaft line of the shaft part, the body and the shaft part go into the combined state from the uncombined state by the shaft part being rotated relative to the body in a predetermined direction, when the body and the shaft part reach the uncombined state by the shaft part being rotated relative to the body in a direction opposite to the predetermined direction by impact received during rotation of the toy top, the body and the shaft part become uncombined, whereby the toy top disassembles into the body and the shaft part, the body and the shaft part respectively have a first portion and a second portion formed to face each other in the up-down direction in the combined state, the toy top further includes: a biasing member; a projection; and a sliding contact surface which abuts the projection by biasing force of the biasing member and on which the projection continuously slides from a position corresponding to a most deeply combined state in the combined state to a position corresponding to the uncombined state, the sliding contact surface is formed on the first portion of the body, and the projection is formed on the second portion of the shaft part, and the sliding contact surface is an inclined plane which, in the combined state, (i) as a whole, inclines with respect to a plane being at right angles to the shaft line, (ii) has a level in the up-down direction being continuously lower from the position corresponding to the most deeply combined state toward the position corresponding to the uncombined state and (iii) can keep abutting the projection at an arbitrary point.

Instead of the sliding contact surface, the toy top may have a sliding contact surface which is a combination of: an inclined plane which, in the combined state, (i) as a whole, inclines with respect to a plane being at right angles to the shaft line, (ii) has a level in the up-down direction being continuously lower from the position corresponding to the most deeply combined state toward the position corresponding to the uncombined state, and (iii) can keep abutting the projection at an arbitrary point; and a flat part which has a uniform level and can keep abutting the projection at an arbitrary point in the combined state.

Preferably, as the biasing member, the toy top has a pressing member including: a hollow cylinder/prism having an upper end on which the projection is formed; a leg part disposed on an outer circumferential wall of the hollow cylinder/prism and projecting downward of the hollow cylinder/prism; and slits formed in the hollow cylinder/prism at two sides of a support part for the leg part, respectively, the slits reaching a lower end of the hollow cylinder/prism, wherein when the relative rotation is performed in a state in which the leg part sits on a predetermined seat part, the leg part and the support part elastically deform.

According to the toy top described above, the sliding contact surface is an inclined plate which, as a whole, inclines with respect to a plane being at right angles to the shaft line, has a level in the up-down direction being continuously lower from the most deeply combined state toward the uncombined state, and can keep abutting the projection at an arbitrary point. This can reduce abrasion and breakage of the projection (s) which are caused by the sliding. Further, in order to characterize battle performance, various torque values of torsion can be set to the sliding contact surface by giving variety to the angle of inclination of the sliding contact surface. Still further, a torque value (s) which cannot be set by the force of a spring only can be set by making use of the flexure restoring force (i.e., elasticity) of the pressing member.

According to another aspect of the present invention, there is provided a toy top for a battle, including: a body disposed on an upper side and having a first pawl; and a shaft part disposed on a lower side and having a second pawl, wherein the body and the shaft part take (i) a combined state in which the first pawl and the second pawl are superposed in an up-down direction such that an upper surface of the first pawl faces a lower surface of the second pawl and (ii) an uncombined state in which the first pawl and the second pawl are not superposed in the up-down direction, according to a relative position of the shaft part to the body reached by a relative rotation of the shaft part to the body on a shaft line of the shaft part, the body and the shaft part go into the combined state from the uncombined state by the shaft part being rotated relative to the body in a predetermined direction, when the body and the shaft part reach the uncombined state by the shaft part being rotated relative to the body in a direction opposite to the predetermined direction by impact received during rotation of the toy top, the body and the shaft part become uncombined, whereby the toy top disassembles into the body and the shaft part, the body and the shaft part respectively have a first portion and a second portion formed to face each other in the up-down direction in the combined state, the toy top further includes: a biasing member; a projection; and a sliding contact surface which abuts the projection by biasing force of the biasing member and on which the projection continuously slides from a position corresponding to a most deeply combined state in the combined state to a position corresponding to the uncombined state, the projection is formed on the first portion of the body, and the sliding contact surface is formed on the second portion of the shaft part, and the sliding contact surface is an inclined plane which, in the combined state, (i) as a whole, inclines with respect to a plane being at right angles to the shaft line, (ii) has a level in the up-down direction being continuously higher from the position corresponding to the most deeply combined state toward the position corresponding to the uncombined state and (iii) can keep abutting the projection at an arbitrary point.

Instead of the sliding contact surface, the toy top may have a sliding contact surface which is a combination of: an inclined plane which, in the combined state, (i) as a whole, inclines with respect to a plane being at right angles to the shaft line, (ii) has a level in the up-down direction being continuously higher from the position corresponding to the most deeply combined state toward the position corresponding to the uncombined state and (iii) can keep abutting the projection at an arbitrary point; and a flat part which has a uniform level and can keep abutting the projection at an arbitrary point in the combined state.

Preferably, as the biasing member, the toy top has a pressing member including: a hollow cylinder/prism having an upper end on which the sliding contact surface is formed; a leg part disposed on an outer circumferential wall of the hollow cylinder/prism and projecting downward of the hollow cylinder/prism; and slits formed in the hollow cylinder/prism at two sides of a support part for the leg part, respectively, the slits reaching a lower end of the hollow cylinder/prism, wherein when the relative rotation is performed in a state in which the leg part sits on a predetermined seat part, the leg part and the support part elastically deform, and the sliding contact surface abuts the projection by elastic force accompanying the elastic deformation.

According to the toy top described above, the sliding contact surface is an inclined plate which, as a whole, inclines with respect to a plane being at right angles to the shaft line, has a level in the up-down direction being continuously higher from the most deeply combined state toward the uncombined state, and can keep abutting the projection at an arbitrary point. This can reduce abrasion and breakage of the projection (s) which are caused by the sliding. Further, in order to characterize battle performance, various torque values of torsion can be set to the sliding contact surface by giving variety to the angle of inclination of the sliding contact surface. Still further, a torque value (s) which cannot be set by the force of a spring only can be set by making use of the flexure restoring force of the pressing member.

What is claimed is:

1. A toy top for a battle, comprising:

a body disposed on an upper side and having a first pawl; and a shaft part disposed on a lower side and having a second pawl, wherein the body and the shaft part take (i) a combined state in which the first pawl and the second pawl are superposed in an up-down direction such that an upper surface of the first pawl faces a lower surface of the second pawl and (ii) an uncombined state in which the first pawl and the second pawl are not superposed in the up-down direction, according to a relative position of the shaft part to the body reached by a relative rotation of the shaft part to the body on a shaft line of the shaft part, the body and the shaft part go into the combined state from the uncombined state by the shaft part being rotated relative to the body in a predetermined direction, when the body and the shaft part reach the uncombined state by the shaft part being rotated relative to the body in a direction opposite to the predetermined direction by impact received during rotation of the toy top, the body and the shaft part become uncombined, whereby the toy top disassembles into the body and the shaft part, the body and the shaft part respectively have a first portion and a second portion formed to face each other in the up-down direction in the combined state, the toy top further comprises: a biasing member; a projection; and a sliding contact surface which abuts the projection by biasing force of the biasing member and on which the projection continuously slides from a position corresponding to a most deeply combined state in the combined state to a position corresponding to the uncombined state, the sliding contact surface is formed on the first portion of the body, and the projection is formed on the second portion of the shaft part, and the sliding contact surface is an inclined plane which, in the combined state, (i) as a whole, inclines with respect to a plane being at right angles to the shaft line, (ii) has a level in the up-down direction being continuously lower from the position corresponding to the most deeply combined state toward the position corresponding to the uncombined state and (iii) can keep abutting the projection at an arbitrary point.

2. A toy top for a battle, comprising:

a body disposed on an upper side and having a first pawl;

a shaft part disposed on a lower side and having a second pawl, wherein the body and the shaft part take (i) a combined state in which the first pawl and the second pawl are superposed in an up-down direction such that an upper surface of the first pawl faces a lower surface of the second pawl and (ii) an uncombined state in which the first pawl and the second pawl are not superposed in the up-down direction, according to a relative position of the shaft part to the body reached by a relative rotation of the shaft part to the body on a shaft line of the shaft part, the body and the shaft part go into the combined state from the uncombined state by the shaft part being rotated relative to the body in a predetermined direction, when the body and the shaft part reach the uncombined state by the shaft part being rotated relative to the body in a direction opposite to the predetermined direction by impact received during rotation of the toy top, the body and the shaft part become uncombined, whereby the toy top disassembles into the body and the shaft part, the body and the shaft part respectively have a first portion and a second portion formed to face each other in the up-down direction in the combined state;

a biasing member;

a projection; and a sliding contact surface which abuts the projection by biasing force of the biasing member and on which the projection continuously slides from a position corresponding to a most deeply combined state in the combined state to a position corresponding to the uncombined state, wherein the sliding contact surface is formed on the first portion of the body, and the projection is formed on the second portion of the shaft part, and wherein the sliding contact surface is a combination of: an inclined plane which, in the combined state, (i) as a whole, inclines with respect to a plane being at right angles to the shaft line, (ii) has a level in the up-down direction being continuously lower from the position corresponding to the most deeply combined state toward the position corresponding to the uncombined state, and (iii) can keep abutting the projection at an arbitrary point; and a flat part which has a uniform level and can keep abutting the projection at an arbitrary point in the combined state.

3. The toy top according to claim 1, wherein, as the biasing member, the toy top has a pressing member including: a hollow cylinder/prism having an upper end on which the projection is formed; a leg part disposed on an outer circumferential wall of the hollow cylinder/prism and projecting downward of the hollow cylinder/prism; and slits formed in the hollow cylinder/prism at two sides of a support part for the leg part, respectively, the slits reaching a lower end of the hollow cylinder/prism, wherein when the relative rotation is performed in a state in which the leg part sits on a predetermined seat part, the leg part and the support part elastically deform.

4. The toy top according to claim 2, wherein, as the biasing member, the toy top has a pressing member including: a hollow cylinder/prism having an upper end on which the projection is formed; a leg part disposed on an outer circumferential wall of the hollow cylinder/prism and projecting downward of the hollow cylinder/prism; and slits formed in the hollow cylinder/prism at two sides of a support part for the leg part, respectively, the slits reaching a lower end of the hollow cylinder/prism, wherein when the relative rotation is performed in a state in which the leg part sits on a predetermined seat part, the leg part and the support part elastically deform.

5. A toy top for a battle, comprising:

a body disposed on an upper side and having a first pawl; and a shaft part disposed on a lower side and having a second pawl, wherein the body and the shaft part take (i) a combined state in which the first pawl and the second pawl are superposed in an up-down direction such that an upper surface of the first pawl faces a lower surface of the second pawl and (ii) an uncombined state in which the first pawl and the second pawl are not superposed in the up-down direction, according to a relative position of the shaft part to the body reached by a relative rotation of the shaft part to the body on a shaft line of the shaft part, the body and the shaft part go into the combined state from the uncombined state by the shaft part being rotated relative to the body in a predetermined direction, when the body and the shaft part reach the uncombined state by the shaft part being rotated relative to the body in a direction opposite to the predetermined direction by impact received during rotation of the toy top, the body and the shaft part become uncombined, whereby the toy top disassembles into the body and the shaft part, the body and the shaft part respectively have a first portion and a second portion formed to face each other in the up-down direction in the combined state, the toy top further comprises: a biasing member; a projection; and a sliding contact surface which abuts the projection by biasing force of the biasing member and on which the projection continuously slides from a position corresponding to a most deeply combined state in the combined state to a position corresponding to the uncombined state, the projection is formed on the first portion of the body, and the sliding contact surface is formed on the second portion of the shaft part, and the sliding contact surface is an inclined plane which, in the combined state, (i) as a whole, inclines with respect to a plane being at right angles to the shaft line, (ii) has a level in the up-down direction being continuously higher from the position corresponding to the most deeply combined state toward the position corresponding to the uncombined state and (iii) can keep abutting the projection at an arbitrary point.

6. A toy top for a battle, comprising:

a body disposed on an upper side and having a first pawl;

a shaft part disposed on a lower side and having a second pawl, wherein the body and the shaft part take (i) a combined state in which the first pawl and the second pawl are superposed in an up-down direction such that an upper surface of the first pawl faces a lower surface of the second pawl and (ii) an uncombined state in which the first pawl and the second pawl are not superposed in the up-down direction, according to a relative position of the shaft part to the body reached by a relative rotation of the shaft part to the body on a shaft line of the shaft part, the body and the shaft part go into the combined state from the uncombined state by the shaft part being rotated relative to the body in a predetermined direction, when the body and the shaft part reach the uncombined state by the shaft part being rotated relative to the body in a direction opposite to the predetermined direction by impact received during rotation of the toy top, the body and the shaft part become uncombined, whereby the toy top disassembles into the body and the shaft part, the body and the shaft part respectively have a first portion and a second portion formed to face each other in the up-down direction in the combined state, the toy top further comprises: a biasing member; a projection; and a sliding contact surface which abuts the projection by biasing force of the biasing member and on which the projection continuously slides from a position corresponding to a most deeply combined state in the combined state to a position corresponding to the uncombined state, wherein the projection is formed on the first portion of the body, and the sliding contact surface is formed on the second portion of the shaft part, and wherein the sliding contact surface is a combination of: an inclined plane which, in the combined state, (i) as a whole, inclines with respect to a plane being at right angles to the shaft line, (ii) has a level in the up-down direction being continuously higher from the position corresponding to the most deeply combined state toward the position corresponding to the uncombined state and (iii) can keep abutting the projection at an arbitrary point; and a flat part which has a uniform level and can keep abutting the projection at an arbitrary point in the combined state.

7. The toy top according to claim 5, wherein, as the biasing member, the toy top has a pressing member including: a hollow cylinder/prism having an upper end on which the sliding contact surface is formed; a leg part disposed on an outer circumferential wall of the hollow cylinder/prism and projecting downward of the hollow cylinder/prism; and slits formed in the hollow cylinder/prism at two sides of a support part for the leg part, respectively, the slits reaching a lower end of the hollow cylinder/prism, wherein when the relative rotation is performed in a state in which the leg part sits on a predetermined seat part, the leg part and the support part elastically deform, and the sliding contact surface abuts the projection by elastic force accompanying the elastic deformation.

8. The toy top according to claim 6, wherein, as the biasing member, the toy top has a pressing member including: a hollow cylinder/prism having an upper end on which the sliding contact surface is formed; a leg part disposed on an outer circumferential wall of the hollow cylinder/prism and projecting downward of the hollow cylinder/prism; and slits formed in the hollow cylinder/prism at two sides of a support part for the leg part, respectively, the slits reaching a lower end of the hollow cylinder/prism, wherein when the relative rotation is performed in a state in which the leg part sits on a predetermined seat part, the leg part and the support part elastically deform, and the sliding contact surface abuts the projection by elastic force accompanying the elastic deformation.

* * * * *